United States Patent [19]

Krongold

[11] Patent Number: 4,607,489

[45] Date of Patent: Aug. 26, 1986

[54] METHOD AND APPARATUS FOR PRODUCING COLD GAS AT A DESIRED TEMPERATURE

[75] Inventor: Martin A. Krongold, Aston, Pa.

[73] Assignee: MG Industries, Valley Forge, Pa.

[21] Appl. No.: 736,387

[22] Filed: May 21, 1985

[51] Int. Cl.[4] ..... F17C 13/02

[52] U.S. Cl. ..... 62/49; 62/50; 62/225; 62/306; 62/307

[58] Field of Search ..... 62/49, 50, 216, 225, 62/306, 307

[56] References Cited

U.S. PATENT DOCUMENTS

| | | | |
|---|---|---|---|
| 3,240,262 | 3/1966 | Nybölet | 261/127 |
| 3,295,563 | 1/1967 | Laya et al. | 62/55 |
| 3,473,343 | 10/1969 | Chamberlain | 62/52 |
| 3,552,135 | 1/1971 | Peavler | 62/91 |
| 3,615,079 | 10/1971 | DeLara | 165/111 |
| 3,626,080 | 12/1971 | Pierce | 174/15 R |
| 3,672,182 | 6/1972 | Stowasser et al. | 62/306 |
| 3,705,621 | 12/1972 | Schoonman | 165/112 |
| 3,726,101 | 4/1973 | Arenson | 62/52 |
| 3,735,568 | 5/1973 | Beck | 261/151 |
| 3,762,893 | 10/1973 | Larson | 62/52 |
| 3,771,260 | 11/1973 | Arenson | 48/190 |
| 3,899,023 | 8/1975 | Zander | 165/111 |
| 4,027,729 | 6/1977 | Bruhl | 165/111 |
| 4,094,164 | 7/1978 | Cope | 62/306 |
| 4,161,108 | 6/1979 | Cope | 62/306 |
| 4,430,865 | 2/1984 | Davis | 62/121 |
| 4,481,780 | 11/1984 | Delano | 62/52 |

*Primary Examiner*—Ronald C. Capossela
*Attorney, Agent, or Firm*—William H. Eilberg

[57] ABSTRACT

A method and apparatus are disclosed for producing a cold gas at a desired temperature, by bubbling the gas to be cooled through a bath of cryogenic liquid. The gas to be cooled need not be the same substance as that in the bath. The gas is preferably introduced at or near the bottom of the bath, and the bubbles give up heat to the bath as they rise. The gas is introduced into the bath through a flow distributor, producing a large quantity of very small bubbles, in order to maximize the rate of heat exchange. Cold gas is extracted from the region above the liquid bath. The higher the level of the bath, the greater the time available for heat exchange between the gas and the bath. Controlling the depth of the bath therefore controls the temperature of the cold gas leaving the apparatus. The depth of the bath is primarily controlled by adjusting the rate of flow of cryogenic liquid into the bath.

22 Claims, 1 Drawing Figure

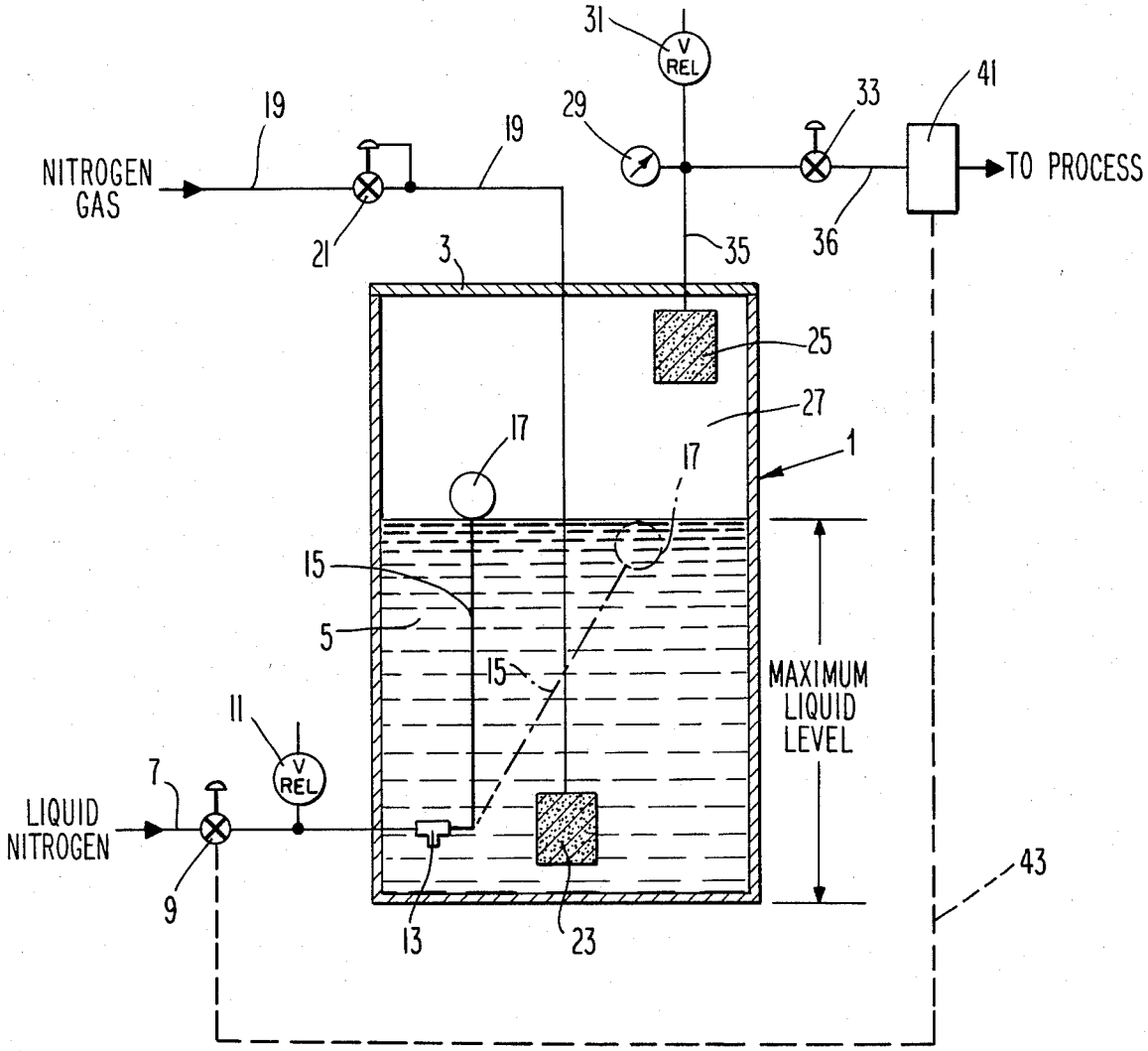
31
V REL
41
19
29
33
19
NITROGEN GAS
TO PROCESS
21
3
35
36
25
27
17
17
1
15
5
15
MAXIMUM LIQUID LEVEL
11
V REL
7
LIQUID NITROGEN
9
13
23
43

METHOD AND APPARATUS FOR PRODUCING COLD GAS AT A DESIRED TEMPERATURE

BACKGROUND OF THE INVENTION

The present invention relates to the field of production of cryogenic and near-cryogenic substances. The invention discloses a method and apparatus for producing a very cold, but not liquid, gas at a predetermined temperature.

Liquid nitrogen is commonly inserted into aluminum cans containing food or beverages, immediately before the cans are sealed. The liquid nitrogen vaporizes and expands by a factor of about 700, creating a large internal pressure, and enabling the aluminum can to withstand the external pressure exerted by other cans in a stack.

Besides adding to the internal pressure, the liquid nitrogen injected into the can serves the purpose of "inerting" the contents of the can. That is, the nitrogen displaces most of the oxygen in the can, due to the rapid vaporization and expansion of the nitrogen in liquid form. Nitrogen is virtually inert at all but the highest temperatures. By eliminating most of the oxygen in the can, and replacing it with nitrogen, the rate of bacterial growth is substantially reduced. In fact, even if oxygen is not actually removed, the addition of nitrogen dilutes the oxygen sufficiently to reduce the effectiveness of the oxygen in supporting the growth of bacteria.

There are applications, however, where the substantial internal pressure due to liquid nitrogen is unnecessary and even undesirable. For example, packages of potato chips or crackers, made of various plastic and/or foil materials, cannot withstand a high internal pressure such as would be produced by vaporization of liquid nitrogen. Yet these and other food products must be capable of being transported and stored, in their containers, for long periods of time, without the growth of harmful bacteria. For this reason, it is desirable to use nitrogen gas which is very cold but not quite liquid. By using a cold gas instead of a liquid, the pressure due to expansion is greatly reduced.

While liquid nitrogen expands by a factor of about 700 when vaporized, cold gaseous nitrogen, say, at −320° F., has an expansion factor of only about 3.8. Cold gaseous nitrogen can therefore be used both to create a modest pressure within a soft container, and to purge unwanted oxygen from its interior.

Various methods of making a cold gas have been described in the prior art. For example, U.S. Pat. No. 3,615,079 describes a heat exchanger wherein a gas to be cooled is bubbled through a liquid heat carrier. U.S. Pat. No. 4,481,780 describes a method for production of a cold gas, the method involving the mixing of a relatively warm gas and a liquid cryogen. U.S. Pat. No. 3,771, 260 discloses a method of combining a gas stream with a liquefied cryogenic fluid. Other examples of heat exchange between liquids and gases, and between gases and gases, are shown in U.S. Pat. Nos. 3,240,262, 3,726,101, 4,027,729, and 3,552,135.

The present invention provides a simple and economical method and apparatus for generating a cold gas, for use in the applications described above, or for other purposes. The apparatus shown provides automatic means of regulating the temperature of the cold gas by regulating the level of cryogenic liquid in a bath.

SUMMARY OF THE INVENTION

The apparatus of the invention comprises an insulated container having a bath of liquid nitrogen. The level of liquid is regulated by automatically adjusting the setting of a control valve which controls the flow of liquid into the bath. The nitrogen gas to be cooled is directed through a conduit to the region near the bottom of the liquid bath. Before reaching the liquid, the gas is made to pass through a filter, thereby producing a large quantity of small bubbles. The resulting bubbles of gas rise through the bath, and together with some of the evaporated liquid from the bath, pass through a second filter, located near the top of the container, before leaving the apparatus. The second filter prevents liquid droplets from entering the outlet line. The only substance allowed to leave the apparatus is therefore ultra-cold gas.

The higher the level of the liquid bath, the greater the time during which the gas bubbles are in direct contact with the bath, and the greater the amount of heat transferred from the gas to the liquid. Therefore, the higher the level of liquid, the lower the temperature of the cooled gas. By increasing the flow of liquid into the bath, and thereby increasing the depth of the bath, the temperature of the cold gas can be made lower. Conversely, reducing the flow of liquid into the bath reduces the depth of the bath, and increases the temperature of the output gas.

The invention will operate with gases other than nitrogen. Also, it is not necessary that the bath be the same substance as the gas to be cooled.

It is therefore an object of the invention to provide a method of producing a cold gas at a desired temperature.

It is another object of the invention to provide a method as described above, wherein the temperature of the cold gas can be varied according to the height of a bath of cryogenic liquid.

It is another object of the invention to provide a method as described above, wherein the temperature of the cold gas can be automatically regulated.

It is another object of the invention to provide a method as described above, the method being suitable for use in cooling virtually any type of gas.

It is another object of the invention to provide a method as described above, wherein the bath and the gas being cooled may or may not be the same substance.

It is another object of the invention to provide a method as described above, wherein the heat exchange between the liquid bath and the gas to be cooled is rapid, and wherein the cooled gas is substantially free of liquid.

It is another object of the invention to provide apparatus for cooling a gas in accordance with the method described above.

It is another object of the invention to provide apparatus as described above, wherein the apparatus has a safety mechanism for preventing overfilling of the bath of cryogenic liquid.

Other objects and advantages of the invention will be apparent to those skilled in the art, from a reading of the following brief description of the drawing, the detailed description of the invention, and the appended claims.

BRIEF DESCRIPTION OF THE DRAWING

The FIGURE is a schematic diagram of the apparatus used to implement the method of the present invention.

DETAILED DESCRIPTION OF THE INVENTION

The apparatus used in the present invention is shown schematically in the FIGURE. While the invention will be described with respect to the cooling of nitrogen, it is understood that any other gas may be cooled by the same apparatus and method.

The apparatus comprises an insulated tank 1 having an insulated lid 3. Tank 1 is partially filled with a bath 5 of liquid nitrogen, or other cryogenic liquid. Liquid nitrogen is supplied to the bath 5 by conduit 7, and through control valve 9. The liquid nitrogen is generally stored at a pressure of about 80 psig, and valve 9 reduces that pressure to about 30 psig. Valve 9 does not, however, regulate the pressure of the liquid. Valve 9 is continuously variable, and is adapted to be operated automatically by suitable electrical, mechanical, pneumatic, or hydraulic means. Safety relief valve 11 provides venting in case of excessive and dangerous pressure buildup.

Liquid nitrogen enters the bath through proportional valve 13, which is connected to float arm 15 and float ball 17. Float arm 15 is allowed to pivot, such that a reduction in the height of the bath 5 causes the arm and ball to fall over, actuating the valve 13, and causing more liquid to be added to the bath. The arm 15 and ball 17 are shown in phantom in a pivoted position. During normal operation, the arm and ball will be in a pivoted position, and float valve 13 will allow the flow of liquid into the container at all times.

Gaseous nitrogen (or any other gas to be cooled) is directed into the apparatus through conduit 19. Like the liquid, the gas to be cooled is stored at a pressure of about 80 psig, and its pressure is reduced to about 30 psig by pressure regulating valve 21. The gaseous nitrogen is made to pass through filter 23 before entering the bath 5. The filter 23 thus comprises a porous wall separating the interior of conduit 19 from the interior of container 1.

Filter 23 is preferably a sintered brass filter having a mesh size in the range of about 1–10 microns. The filter acts as a flow distributor; the gas passing through the filter is distributed in the form of many tiny bubbles. The surface area over which the gas contacts the liquid is thus quite large, and heat transfer between liquid and gas is therefore very rapid.

As indicated in the FIGURE, the filter is located at or near the bottom of the container, so that gas entering the bath must rise through substantially the entire height of the bath. The filter could be placed somewhat higher, with a corresponding loss of cooling efficiency.

Filter 25, of substantially the same construction as filter 23, is mounted near the top of container 1, and is connected to outlet conduit 35. Filter 25 prevents entrained droplets of liquid from leaving the container and entering outlet conduit 35. Any droplets reaching the filter will coalesce and form larger droplets, which will eventually fall back into the bath. If a droplet is small enough to pass through filter 25, it undoubtedly will vaporize quickly. Thus, only gas will flow through the outlet line.

Liquid droplets are most likely to occur when the gas is being cooled to a temperature approaching the liquid-gas equilibrium temperature. If the gas being cooled remains substantially above this temperature, the problem of liquid droplets is less likely to arise. In the latter case, virtually all of the liquid droplets will have been vaporized by contact with the relatively warmer gas, before reaching filter 25.

The output line is represented by conduits 35 and 36. Pressure gauge 29 indicates the pressure in conduit 35, which is usually close to the pressure of the gas and liquid within tank 1. The pressure in conduit 36 is usually close to atmospheric pressure. Pressure relief valve 31 is a safety device, providing venting if the pressure in the line exceeds an acceptable level. Flow control valve 33 controls the passage of gas through conduits 35 and 36.

Conduit segment 36 includes temperature sensor 41, which is operatively connected to control the valve 9, as indicated by dotted line 43. The valve is controlled by any conventional electric, mechanical, pneumatic, or hydraulic means. When the temperature of the gas leaving the container exceeds a predetermined value, sensor 41 sends a signal to valve 9, causing that valve to increase the rate of flow of liquid into the container, and thereby increasing the depth of the bath. The temperature of the gas leaving the apparatus is thus reduced. If the sensed temperature is lower than another predetermined value, sensor 41 causes valve 9 to reduce the flow of liquid into the container, thereby decreasing the depth of the bath, and increasing the temperature of the output gas.

The maximum liquid level is indicated on the drawing. When the liquid level is at the maximum point, float arm 15 is in the vertical position, as shown, and float valve 13 is closed. In normal operation, the liquid level is less than this maximum value, perhaps only 75% of the maximum. Therefore, it is expected that some liquid will be continuously passing through float valve 13, although the rate of flow will vary. Since the normal level of the bath is substantially less than the maximum level, the regulation of level due to the temperature sensor 41 does not interfere with the regulation due to the float valve. Indeed, the float ball and valve are intended as a safety device, the actual temperature control being accomplished by sensor 41 and control valve 9.

If the level of liquid approaches or reaches the maximum liquid level, it is likely that the container being used is too small for the desired application. In order to reduce further the temperature of the product gas, one must provide a container capable of holding a bath having a greater depth.

The cooled gas produced by the invention derives in part from the relatively warm gas entering through conduit 19, and from gas head 27, in the region above the liquid bath. The gas head simply results from normal evaporation of the bath. In the embodiment shown, both the incoming gas and the incoming liquid are nitrogen, so the final product gas is also nitrogen. In general, it is possible to use one substance for the incoming gas and a different substance for the bath. In the latter case, the product gas will be a mixture of these two substances.

The invention has been described with reference to nitrogen, because of the usefulness of nitrogen in the handling of packaged food, as described above. But the invention can be used in any other context wherein it is necessary to provide a very cold gas. Thus the gas to be cooled could be an inert gas such as argon, or a reactive gas such as propane, or any other gas. The principle of the invention remains the same.

Other modifications of the invention are possible. The types of filters employed can be varied. The positioning of the filters is not critical, although it is preferable that they be located at opposite ends of the container, and that filter 25 be substantially above the maximum liquid level. Positioning filter 25 near the top of the container further reduces the chance that liquid droplets will enter the output line, because the droplets will be in contact with the gas, above the liquid bath, for a longer time.

Examples of other possible modifications include the precise number and arrangement of valves. The means of controlling valve 9 by temperature sensor 41 can be changed. Control of the maximum liquid level in the container can be done by means other than a float ball and valve assembly. It is understood that these and other modifications are to be deemed within the spirit and scope of the following claims.

What is claimed is:

1. A method of producing a cold gas at a desired temperature, comprising the steps of:

(a) directing a gas to be cooled through a bath of a cryogenic liquid, (b) maintaining the depth of the bath at a predetermined level, wherein the temperature of the gas is controlled by controlling the level of the bath, and (c) withdrawing cooled gas from the region above the bath.

2. The method of claim 1, wherein the directing step is preceded by the steps of conducting the gas to a lower region of the bath, and distributing the gas as a large quantity of small bubbles, before the gas is passed through the liquid.

3. The method of claim 2, wherein the withdrawing step is preceded by the step of passing the cooled gas through a filter.

4. The method of claim 3, wherein the gas to be cooled is the same substance as that of the liquid bath.

5. The method of claim 3, wherein the gas to be cooled is a different substance from that of the liquid bath.

6. A method of producing a cold gas at a desired temperature, comprising the steps of:

(a) directing a gas to be cooled through a bath of a cryogenic liquid, (b) maintaining the depth of the bath at a predetermined level, and (c) withdrawing cooled gas from the region above the bath, wherein the directing step is preceded by the steps of conducting the gas to the lower region of the bath, and distributing the gas as a large quantity of small bubbles, before the gas is passed through the liquid, wherein the withdrawing step is preceded by the step of passing the cooled gas through a filter, and wherein the maintaining step comprises the steps of sensing the temperature of the cold gas leaving the system, and passing a stream of liquid into the bath at a selected flow rate, the flow rate being varied according to the temperature of the cold gas, wherein the level of liquid is increased or decreased according to whether the temperature of the cold gas is too high or too low.

7. The method of claim 6, further comprising the step of shutting off the flow of liquid into the bath when the level of the bath reaches a predetermined maximum acceptable value.

8. The method of claim 7, wherein the directing step includes the steps of reducing the pressure of the incoming gas to be cooled, and regulating the pressure of said gas at a preselected pressure level.

9. The method of claim 8, wherein the liquid passing step includes the step of reducing the pressure of the incoming liquid stream.

10. Apparatus for producing a cold gas at a desired temperature, comprising:

(a) means for storing a bath of a cryogenic liquid, (b) conduit means for directing a gas to be cooled from a source to the interior of the storing means, (c) means for maintaining the depth of the bath at a predetermined level, the maintaining means being responsive to the temperature of the cooled gas leaving the apparatus, wherein the temperature of the gas can be controlled by controlling the depth of the bath, and (d) means for withdrawing cooled gas from the storing means.

11. The apparatus of claim 10, wherein the conduit means terminates in a filter means, the filter means defining a porous wall between the conduit means and the interior of the storing means.

12. Apparatus for producing a cold gas at a desired temperature, comprising:

(a) means for storing a bath of a cryogenic liquid, (b) conduit means for directing a gas to be cooled from a source to the interior of the storing means, (c) means for maintaining the depth of the bath at a predetermined level, the maintaining means being responsive to the temperature of the cooled gas leaving the apparatus, and (d) means for withdrawing cooled gas from the storing means, wherein the conduit means terminates in a filter means, the filter means defining a porous wall between the conduit means and the interior of the storing means, and wherein the withdrawing means includes a second filter means disposed near the top of the interior of the storing means.

13. The apparatus of claim 12, further comprising means for replenishing the bath with additional cryogenic liquid.

14. The apparatus of claim 13, wherein the maintaining means comprises a temperature sensor adapted to measure the temperature of the cold gas exiting the apparatus, the temperature sensor being operatively connected to the replenishing means.

15. The apparatus of claim 14, wherein the conduit means includes means for reducing the pressure of the incoming gas, and for regulating the pressure at its reduced level.

16. The apparatus of claim 15, wherein the replenishing means includes means for reducing the pressure of the incoming cryogenic liquid.

17. The apparatus of claim 16, wherein the mesh size of the first and second filter means is about 1–10 microns.

18. Apparatus for producing a cold gas at a preselected temperature, comprising:

an insulated container capable of storing a cryogenic liquid, (b) means for continuously filling the container with a cryogenic liquid, (c) conduit means for directing a gas to be cooled into the xontainer, (d) the conduit means terminating in a filter means, wherein the filter means comprises a porous wall between the conduit means and the interior of the container, (e) outlet means for directing gas out of the container, and (f) temperature sensing means, disposed in the outlet means; the temperature sensing means being operatively connected to the filling means, wherein the rate of filling of the container can be varied in response to variations in the temperature of the gas passing through the outlet means, wherein the outlet means includes a second filter means, wherein gas leaving the container and entering the second filter means must pass through the filter means.

19. The apparatus of claim 18, further comprising means for preventing the filling of the container when the level of liquid in the container has reached a predetermined value.

20. Apparatus for producing a cold gas at a preselected temperature, comprising:

(a) an insulated container capable of storing a cryogenic liquid, (b) means for continuously filling the container with a cryogenic liquid, (c) conduit means for directing a gas to be cooled into the container, (d) the conduit means terminating in a filter means, wherein the filter means comprises a porous wall between the conduit means and the interior of the container, (e) outlet means for directing gas out of the container, and (f) temperature sensing means, disposed in the outlet means, the temperature sensing means being operatively connected to the filling means, wherein the rate of filling of the container can be varied in response to variations in the temperature of the gas passing through the outlet means, wherein the temperature of the gas is controlled by controlling the depth of liquid in the container.

21. A method of producing a cold gas at a desired temperature, comprising the steps of:

(a) directing a gas to be cooled through a bath of a cryogenic liquid, (b) maintaining the depth of the bath at a predetermined level, and (c) withdrawing cooled gas from the region above the bath, wherein the depth maintaining step is the sole means of regulating the amount of cooling of the gas.

22. Apparatus for producing a cold gas at a desired temperature, comprising:

(a) means for storing a bath of a cryogenic liquid, (b) conduit means for directing a gas to be cooled from a source to the interior of the storing means, (c) means for maintaining the depth of the bath at a predetermined level, the maintaining means being responsive to the temperature of the cooled gas leaving the apparatus, the maintaining means being the sole means for regulating the amount of cooling of the gas, and (d) means for withdrawing cooled gas from the storing means.

* * * * *